US008432109B2

(12) United States Patent
Yang et al.

(10) Patent No.: US 8,432,109 B2
(45) Date of Patent: Apr. 30, 2013

(54) METHOD AND APPARATUS FOR A LED DRIVER WITH HIGH POWER FACTOR

(75) Inventors: Ta-Yung Yang, Milpitas, CA (US); Li Lin, Taipei (TW); Chih-Hsien Hsieh, Changhua County (TW); Chuh-Ching Li, Taoyuan County (TW); Chi-Yin Lo, Kaohsiung County (TW); Kuo-Hsiem Huang, Taipei County (TW)

(73) Assignee: System General Corp., Taipei Hsien (TW)

( * ) Notice: Subject to any disclaimer, the term of this patent is extended or adjusted under 35 U.S.C. 154(b) by 217 days.

(21) Appl. No.: 13/073,095

(22) Filed: Mar. 28, 2011

(65) Prior Publication Data

US 2012/0081039 A1 Apr. 5, 2012

Related U.S. Application Data

(60) Provisional application No. 61/388,823, filed on Oct. 1, 2010.

(51) Int. Cl.
*H05B 37/02* (2006.01)

(52) U.S. Cl.
USPC ..... 315/307; 315/212; 315/224; 315/276; 315/291

(58) Field of Classification Search ..... 315/212, 315/219, 291, 294, 297, 186, 224, 254, 276, 315/307
See application file for complete search history.

(56) References Cited

U.S. PATENT DOCUMENTS

| | | | | |
|---|---|---|---|---|
| 6,977,824 | B1 | 12/2005 | Yang et al. | |
| 7,016,204 | B2 | 3/2006 | Yang et al. | |
| 7,116,090 | B1 | 10/2006 | Yang et al. | |
| 7,349,229 | B1 | 3/2008 | Yang | |
| 7,486,528 | B2 | 2/2009 | Yang | |
| 8,305,001 | B2 * | 11/2012 | Horiuchi et al. | 315/219 |
| 8,305,004 | B2 * | 11/2012 | Shao | 315/247 |
| 2011/0025225 | A1 * | 2/2011 | Horiuchi et al. | 315/291 |
| 2011/0062876 | A1 * | 3/2011 | Yang et al. | 315/219 |
| 2011/0298390 | A1 * | 12/2011 | Su et al. | 315/291 |
| 2012/0025736 | A1 * | 2/2012 | Singh et al. | 315/307 |
| 2012/0056551 | A1 * | 3/2012 | Zhu et al. | 315/232 |
| 2012/0112645 | A1 * | 5/2012 | Lee et al. | 315/186 |
| 2012/0146545 | A1 * | 6/2012 | Nerone | 315/297 |
| 2012/0153834 | A1 * | 6/2012 | Moss | 315/122 |

* cited by examiner

*Primary Examiner* — Don Le
(74) *Attorney, Agent, or Firm* — Rosenberg, Klein & Lee

(57) ABSTRACT

A control circuit of a LED driver according to the present invention comprises an output circuit, an input circuit and an input-voltage detection circuit. The output circuit generates a switching signal to produce an output current for driving at least one LED in response to a feedback signal. The switching signal is coupled to switch a transformer. The input circuit samples an input signal for generating the feedback signal. The input signal is correlated to the output current of the LED driver. The input-voltage detection circuit generates an input-voltage signal in response to an input voltage of the LED driver. The input circuit will not sample the input signal when the input-voltage signal is lower than a threshold. The control circuit can eliminate the need of the input capacitor for improving the reliability of the LED driver.

20 Claims, 5 Drawing Sheets

METHOD AND APPARATUS FOR A LED DRIVER WITH HIGH POWER FACTOR

REFERENCE TO RELATED APPLICATION

This Application is based on Provisional Patent Application Ser. No. 61/388,823, filed 1 Oct. 2010.

BACKGROUND OF THE INVENTION

1. Field of the Invention

The present invention relates to LED driver, and more specifically, the present invention relates to the control circuit and control method for LED driver with high power factor.

2. Description of Related Art

The offline LED driver normally will use flyback power conversion with primary side regulation for the output current regulation. FIG. 1 shows a prior art of an offline LED driver that has an input electrolytic capacitor 40 for the energy store. As shown in FIG. 1, the conventional offline LED driver includes a rectifier 12. The rectifier 12 receives an input line voltage $V_{AC}$ and rectifies the input line voltage $V_{AC}$. The input electrolytic capacitor 40 is coupled to an output terminal of the rectifier 12 for the energy store. A voltage $V_{DC}$ is provided by the input electrolytic capacitor 40. A transformer 10 has a primary winding $N_P$, a secondary winding $N_S$ and an auxiliary winding $N_A$.

A terminal of the primary winding $N_P$ is coupled to receive the voltage $V_{DC}$. Another terminal of the primary winding $N_P$ is coupled to a transistor 20. The transistor 20 is utilized to switch the transformer 10. A terminal of the secondary winding $N_S$ is coupled to a terminal of a rectifier 60. An output capacitor 65 is connected between another terminal of the rectifier 60 and another terminal of the secondary winding $N_S$ for providing an output voltage $V_O$ to a plurality of LEDs 70~79. The LEDs 70~79 are connected each other in series and connected to the output capacitor 65 in parallel. A terminal of the auxiliary winding $N_A$ is coupled to an anode terminal of a diode 41. A capacitor 45 is coupled between a cathode terminal of the diode 41 and the ground. The auxiliary winding $N_A$ charge the capacitor 45 through the diode 41 to generate a power source $V_{CC}$ for a switching controller 50.

The terminal of the auxiliary winding $N_A$ is further coupled to a voltage divider. The voltage divider has resistors 51 and 52. The resistors 51 and 52 are connected each other in series. The voltage divider generates a voltage-sense signal $V_S$. The resistor 52 is further coupled to the ground. The switching controller 50 is coupled to a joint point of the resistors 51 and 52 for receiving the voltage-sense signal $V_S$. The switching controller 50 generates a switching signal SW. The switching signal SW controls the transistor 20 to switch the transformer 10 for regulating an output (output current $I_O$ and/or the output voltage $V_O$) of the LED driver. When the transistor 20 is turned on, a switching current $I_P$ will flow through the transformer 10. Through a resistor 30 coupled to the transistor 20, the switching current $I_P$ is utilized to generates a current-sense signal $V_{CS}$. The current-sense signal $V_{CS}$ is coupled to the switching controller 50.

The waveforms of the input line voltage $V_{AC}$ and the voltage $V_{DC}$ are shown in FIG. 2. The voltage $V_{DC}$ is the voltage on the input electrolytic capacitor 40. The minimum voltage of the voltage $V_{DC}$ will maintain the power conversion operated properly. However, the input electrolytic capacitor 40 causes the distortion of an input current $I_{DC}$ and generate poor power factor (PF). Therefore, the capacitance of the input electrolytic capacitor 40 must be reduced to improve the power factor. However, without the input electrolytic capacitor 40 will cause the voltage $V_{DC}$ to be low. The low voltage of the voltage $V_{DC}$ may cause the feedback open loop for the LED driver. The output voltage $V_O$ of the LED driver can be expressed as, $$V_O = N \times V_{DC} \times \frac{T_{ON}}{T - T_{ON}} \tag{1}$$

where the N is turn ratio of the transformer 10 ($N=N_S/N_P$; $N_P$ is the primary winding, $N_S$ is the secondary winding); the $V_{DC}$ is the input voltage of the transformer 10; $T_{ON}$ is the on-time of the transistor 20; T is the switching period of the transistor 20.

In order to achieve a stable feedback loop and prevent the transformer saturation, the maximum duty cycle "$T_{ON}/T$" is limited, such as <80% in general. If the voltage $V_{DC}$ is too low, the maximum on-time $T_{ON}$ of the switching signal SW will unable to maintain the output voltage $V_O$ (shown in equation (1)) and cause the feedback open loop. When the feedback loop is significantly on/off (close-loop and open-loop) in response to the change of the input line voltage $V_{AC}$, an overshoot and/or undershoot signal can be easily generated at the output of the LED driver. Besides, the input electrolytic capacitor 40 is an electrolytic capacitor that is bulky and low reliability. The object of this invention is to improve the power factor of the LED driver. Another object of this invention includes eliminating the need of the input electrolytic capacitor 40 for improving the reliability of the LED driver and reducing the size and the cost of the LED driver.

SUMMARY OF THE INVENTION

It is an objective of the present invention to provide a control circuit and a control method for LED driver. It can eliminate the need of the input capacitor for improving the reliability of the LED driver.

It is an objective of the present invention to provide a control circuit and a control method for LED driver. It can control the LED driver to provide output regulation without input capacitor for improving the power factor, reducing the size and the cost of the LED driver.

It is an objective of the present invention to provide a control circuit and a control method for LED driver. It can control the LED driver to provide the constant current for driving the LED.

The present invention provides a control circuit and a control method for LED driver without input electrolytic capacitor. The control circuit according to the present invention comprises an output circuit, an input circuit and an input-voltage detection circuit.

The output circuit generates a switching signal to produce an output current for driving at least one LED in response to a feedback signal. The switching signal is coupled to switch a transformer. The input circuit samples an input signal for generating the feedback signal. The input signal is correlated to the output current of the LED driver. The input-voltage detection circuit generates an input-voltage signal in response to an input voltage of the LED driver. The input circuit will not sample the input signal when the input-voltage signal is lower than a threshold.

BRIEF DESCRIPTION OF THE DRAWINGS

The invention can be more fully understood by reading the subsequent detailed description and examples with references made to the accompanying drawings, wherein.

DESCRIPTION OF THE PREFERRED EMBODIMENTS

The following description is of the best-contemplated mode of carrying out the invention. This description is made for the purpose of illustrating the general principles of the invention and should not be taken in a limiting sense. The scope of the invention is best determined by reference to the appended claims.

Figure 3:
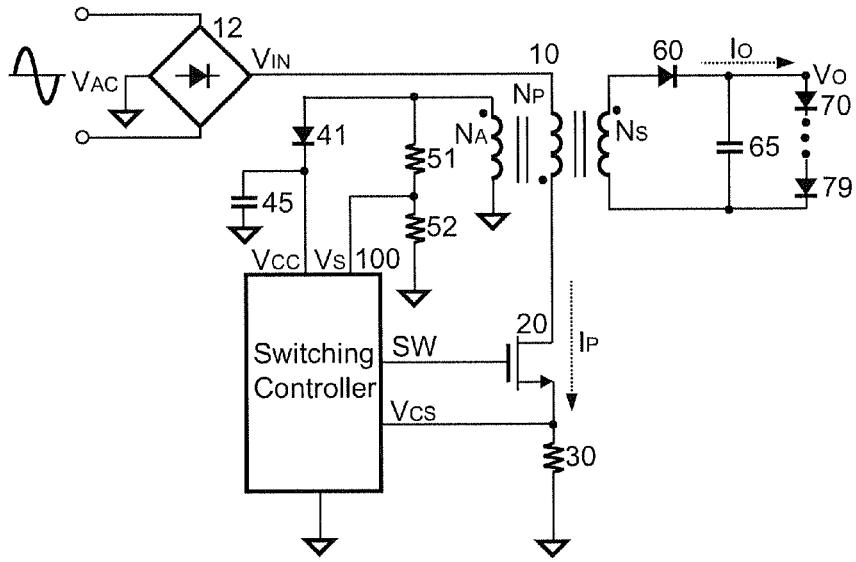
FIG. 3 shows a schematic circuit diagram of an embodiment of the LED driver according to the present invention.

FIG. 3 is a preferred embodiment of the present invention. The detail description of the primary-side controlled flyback power converter can be found in the prior arts of "Control circuit for controlling output current at the primary side of a power converter", U.S. Pat. No. 6,977,824; "Close-loop PWM controller for primary-side controlled power converters", U.S. Pat. No. 7,016,204; "Causal sampling circuit for measuring reflected voltage and demagnetizing time of transformer", U.S. Pat. No. 7,349,229; and "Linear-predict sampling for measuring demagnetized voltage of transformer", U.S. Pat. No. 7,486,528. Refer to the power factor correction, the skill has been disclosed in the prior art of "Switching control circuit for discontinuous mode PFC converters", U.S. Pat. No. 7,116,090.

Figure 1:
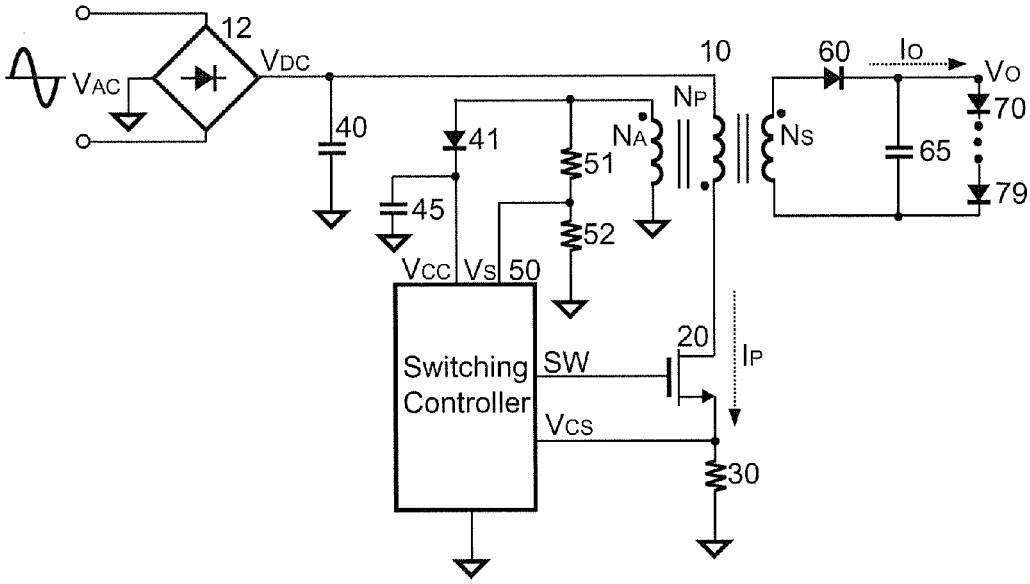
FIG.1(PRIOR ART)
FIG. 1 shows a schematic circuit diagram of the conventional offline LED driver with an input electrolytic capacitor.
Figure 2:
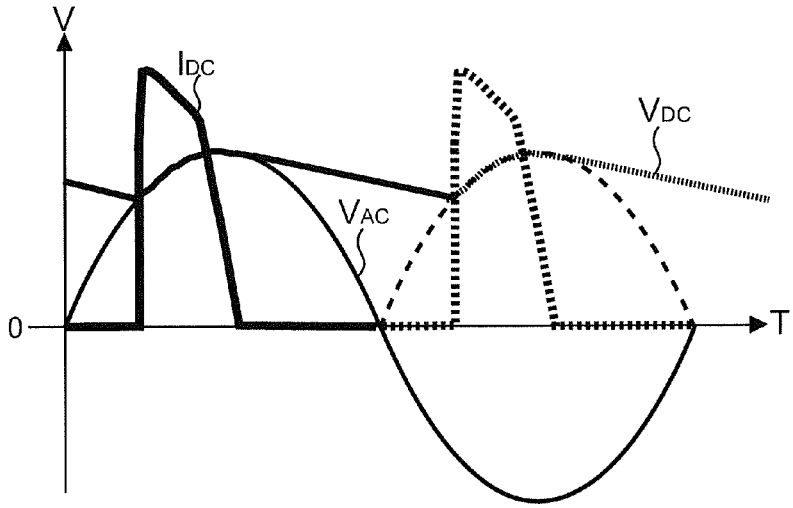
FIG.2(PRIOR ART)
FIG. 2 shows waveforms of the input line voltage $V_{AC}$, the voltage $V_{DC}$ and the input current $I_{DC}$ of the conventional offline LED driver.

As shown in FIG. 3, this embodiment of the present invention is almost the same as the conventional offline LED driver (as shown in FIG. 1) except for the switching controller 100. Further, this embodiment doesn't need the input electrolytic capacitor 40 (as shown in FIG. 1). The transformer 10 includes the primary winding $N_P$, the auxiliary winding $N_A$ and the secondary winding $N_S$. The primary winding $N_P$ is coupled to receive an input voltage $V_{IN}$. The rectifier 12 receives the input line voltage $V_{AC}$ and rectifies the input line voltage $V_{AC}$ for generating the input voltage $V_{IN}$. Resistors 51 and 52 are connected to the auxiliary winding $N_A$ for generating the voltage-sense signal $V_S$ coupled to the switching controller 100.

The voltage-sense signal $V_S$ is a voltage signal correlated to the output voltage $V_O$ and the level of the input voltage $V_{IN}$. The switching controller 100 is a control circuit that generates the switching signal SW. The switching signal SW is coupled to switch the transformer 10 through the transistor 20 for regulating an output (the output current $I_O$ and/or the output voltage $V_O$). The switching controller 100 is a primary-side controlled controller. The resistor 30 is connected between the transistor 20 and the ground. When the transistor 20 is turned on, the switching current $I_p$ will flow through the transformer 10. Via the resistor 30, the switching current $I_P$ is further utilized to generate the current-sense signal $V_{CS}$. The current-sense signal $V_{CS}$ is coupled to the switching controller 100. The switching current $I_P$ is a current signal and correlated to the output current $I_O$ and the input voltage $V_{IN}$. Therefore, the current-sense signal $V_{CS}$ represents the switching current $I_P$ and is correlated to the output current $I_O$. The diode 41 and the capacitor 45 are coupled to the auxiliary winding $N_A$ to generate the power source $V_{CC}$ for the switching controller 100.

Figure 4:
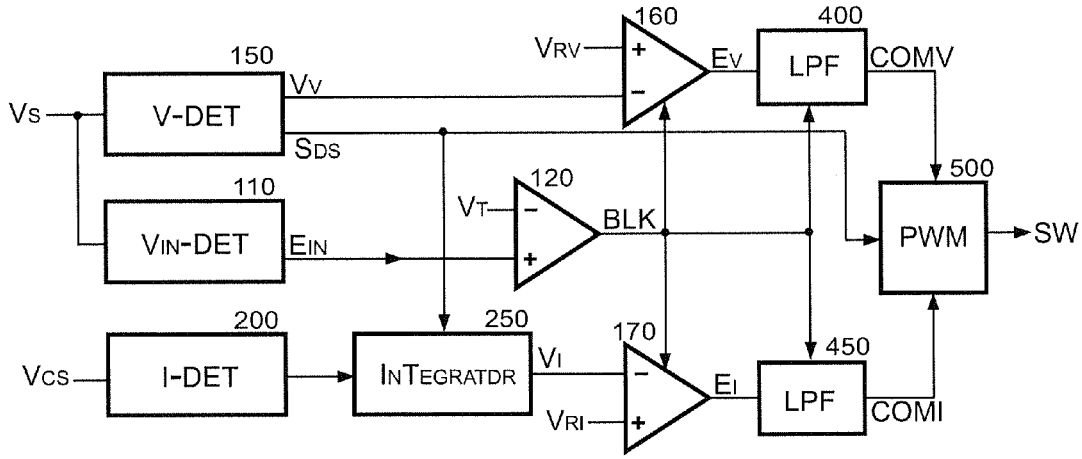
FIG. 4 shows a schematic circuit diagram of an embodiment of a switching controller according to the present invention.

FIG. 4 is a circuit diagram of a preferred embodiment of the switching controller 100. The switching controller 100 comprises a first input circuit and a second input circuit. The first input circuit includes a voltage-detection circuit (V-DET) 150, a first error amplifier 160 and a first low-pass filter (LPF) 400. The second input circuit includes a current-detection circuit (I-DET) 200, an integrator 250, a second error amplifier 170 and a second low-pass filter (LPF) 450. The voltage-sense signal $V_S$ and the current-sense signal $V_{CS}$ are a first input signal and a second input signal provided to the voltage-detection circuit 150 and the current-detection circuit 200, respectively. The voltage-detection circuit 150 is connected to the voltage-sense signal $V_S$ and samples the voltage-sense signal $V_S$ to generate a first feedback signal and a demagnetizing-time signal $S_{DS}$. The first feedback signal is a voltage-feedback signal $V_V$. The demagnetizing-time signal $S_{DS}$ is coupled to the integrator 250. The voltage-feedback signal $V_V$ is coupled to the first error amplifier 160 to generate a first amplified signal $E_V$ by comparing with a first reference signal $V_{RV}$. The first error amplifier 160 is used for developing a feedback loop. The first low-pass filter 400 is connected to the first amplified signal $E_V$ for a loop compensation (frequency compensation for the feedback loop) and generating a voltage-loop signal COMV. The detail description of the voltage-detection circuit 150 can be found in the prior arts, such as U.S. Pat. No. 7,016,204.

The current-detection circuit 200 is connected to the current-sense signal $V_{CS}$ to generate a second feedback signal through the integrator 250. The second feedback signal is a current-feedback signal $V_I$. The current-detection circuit 200 measures the current-sense signal $V_{CS}$ to generate a current-waveform signal. The integrator 250 integrates the current-waveform signal with the demagnetizing-time signal $S_{DS}$ for generating the current-feedback signal $V_I$. It means that the current-detection circuit 200 samples the current-sense signal $V_{CS}$ for generating the current-feedback signal $V_I$. The integrator 250 is utilized for a constant current control. The detail description of the current-detection circuit 200 and the integrator 250 can be found in the prior arts, such as U.S. Pat. No. 7,016,204.

The current-feedback signal $V_I$ is further coupled to the second error amplifier 170 to generate a second amplified signal $E_I$ by comparing with a second reference signal $V_{RI}$. The second error amplifier 170 is used for developing another feedback loop. The second low-pass filter 450 is connected to the second amplified signal $E_I$ for the other compensation (frequency compensation for this feedback loop) and generating a current-loop signal COMI. Both the voltage-loop signal COMV and the current-loop signal COMI are coupled to a PWM circuit 500 to generate the switching signal SW. The PWM circuit 500 is further coupled to receive the demagnetizing-time signal $S_{DS}$.

The PWM circuit 500 is an output circuit that is utilized to generate the switching signal SW in response to the feedback signals. The switching signal SW is coupled to switch the transformer 10 through the transistor 20 for regulating the output of the LED driver. It is to say, the PWM circuit 500 generates the switching signal SW for regulating the output of the LED driver in response to the voltage-feedback signal $V_V$ and the current-feedback signal $V_I$. The output of the LED driver is the output voltage $V_O$ and/or the output current $I_O$ (as shown in FIG. 3).

The output current $I_O$ of the LED driver is a constant current for driving LEDs 70~79 (as shown in FIG. 3). Thus, the switching signal SW is controlled by the current-loop signal COMI to achieve a constant output current $I_O$ in the normal condition. The voltage-loop signal COMV is utilized to limit the maximum output voltage $V_O$ only during the LEDs 70~79 is open-circuited. Therefore, in order to achieve a high PF, the second low-pass filter 450 is developed to provide a "constant on-time" for the switching signal SW during the period of line frequency. Thus, the bandwidth of the second low-pass filter 450 should be lower than the line frequency and the current-feedback signal $V_I$ is a low bandwidth signal for achieving the constant on-time for the switching signal SW. The line frequency is 50 or 60 Hz in general, but the input line voltage $V_{AC}$ (as shown in FIG. 3) is rectified by the bridge rectifier 12, the line frequency is doubled after the bridge rectifier 12 rectifies the input line voltage $V_{AC}$, such as 120 Hz.

The voltage-sense signal $V_S$ is further coupled to an input-voltage detection circuit ($V_{IN}$-DET) 110 to generate an input-voltage signal $E_{IN}$. The voltage-sense signal $V_S$ is correlated to the input voltage $V_{IN}$ of the LED driver (as shown in FIG. 3). Therefore, the input-voltage detection circuit 110 detects the input voltage $V_{IN}$ of the LED driver through the resistors 51, 52 and generates the input-voltage signal $E_{IN}$ in response to the voltage level of the input voltage $V_{IN}$ of the LED driver. Thus, the level of the input-voltage signal $E_{IN}$ is correlated to the voltage level of the input voltage $V_{IN}$ of the LED driver. The input-voltage signal $E_{IN}$ is coupled to a comparator 120 to compare with a threshold $V_T$.

The comparator 120 will generate a blanking signal BLK (a low-true signal) when the input-voltage signal $E_{IN}$ is lower than the threshold $V_T$. The blanking signal BLK is coupled to the error amplifiers 160, 170 to stop the sampling of the voltage-feedback signal $V_V$ and the current-feedback signal $V_I$. It is like the input circuits stopping sampling the input signal (voltage-sense signal $V_S$ and/or the current-sense signal $V_{CS}$) when the input-voltage signal $E_{IN}$ is lower than the threshold $V_T$. The blanking signal BLK is further coupled to low-pass filters 400, 450 to inhibit the sampling of the amplified signals $E_V$ and $E_I$.

Figure 5:
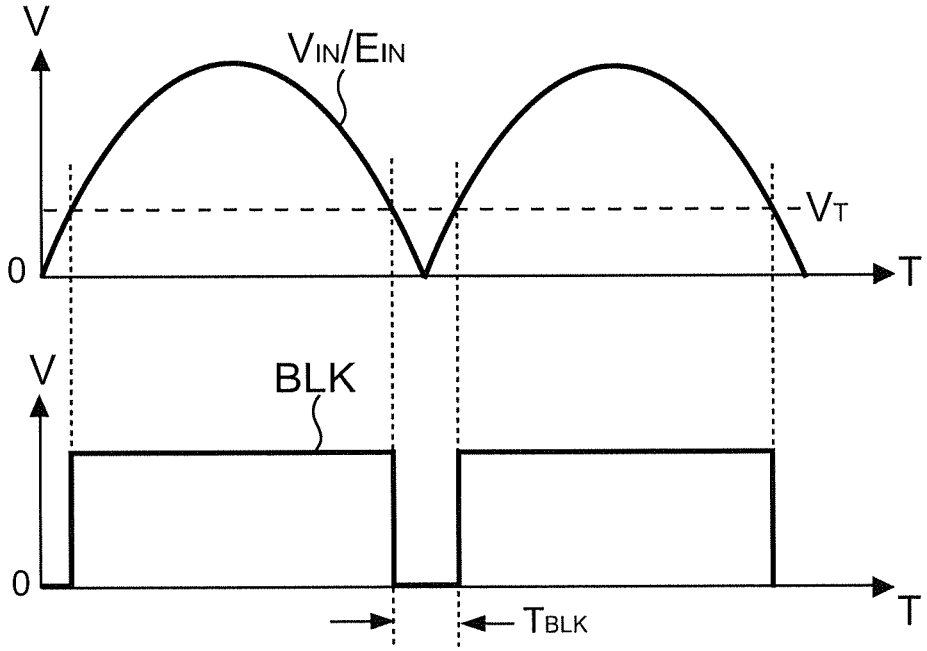
FIG. 5 shows waveform of the blanking signal BLK in response to the input voltage $V_{IN}$ and the input-voltage signal $E_{IN}$ according to the present invention.

FIG. 5 shows the waveform of the blanking signal BLK in response to the input voltage $V_{IN}$ and the input-voltage signal $E_{IN}$. The blanking signal BLK (a low-true signal) is generated when the input-voltage signal $E_{IN}$ is lower than the threshold $V_T$.

Figure 6:
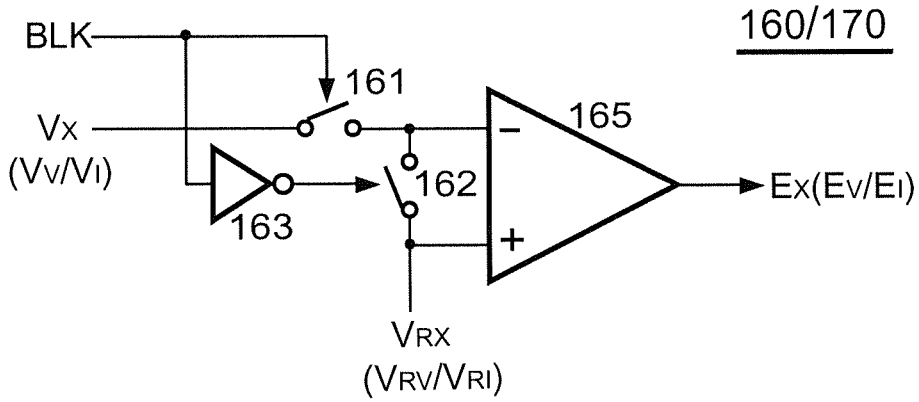
FIG. 6 shows a schematic circuit diagram of an embodiment of the error amplifier of the switching controller according to the present invention.

FIG. 6 shows a preferred circuit schematic of the error amplifiers 160, 170. The error amplifiers 160, 170 are used for error-amplifying the feedback signal $V_X$, such as the voltage-feedback signal $V_V$ or the current-feedback signal $V_I$, and stopping the error-amplifying when the input-voltage signal $E_{IN}$ is lower than the threshold $V_T$ (as shown in FIG. 5). An operational amplifier 165 is a transconductance amplifier that is used for generating the amplified signal $E_X$, such as the first amplified signal $E_V$ or the second amplified signal $E_I$.

A switch 161 is coupled to receive the feedback signal $V_X$, such as the voltage-feedback signal $V_V$ or the current-feedback signal $V_I$, and connected to the negative-input of the operational amplifier 165. A reference signal $V_{RX}$ (e.g. the first reference signal $V_{RV}$ or the second reference signal $V_{RI}$) is connected to the positive-input of the operational amplifier 165. A switch 162 is coupled in between the positive-input and the negative-input of the operational amplifier 165. The blanking signal BLK is coupled to control the switch 161. Through an inverter 163, the blanking signal BLK is coupled to control the switch 162. Therefore, the negative-input of the operational amplifier 165 is connected to the feedback signal $V_X$ normally.

For the transconductance amplifier, it is no current output and high impedance when the inputs of the transconductance amplifier are short circuit. Therefore, once the blanking signal BLK is enabled (logical low level), the negative-input and the positive-input of the operational amplifier 165 are short circuit and are connected to the reference signal $V_{RX}$ due to the switch 161 is turned off and the switch 162 is turned on. Therefore, the error amplifiers 160, 170 are disconnected with the feedback signal $V_X$. It is like the error amplifiers 160, 170 stopping the error-amplifying when the input-voltage signal $E_{IN}$ is lower than the threshold $V_T$.

Figure 7:
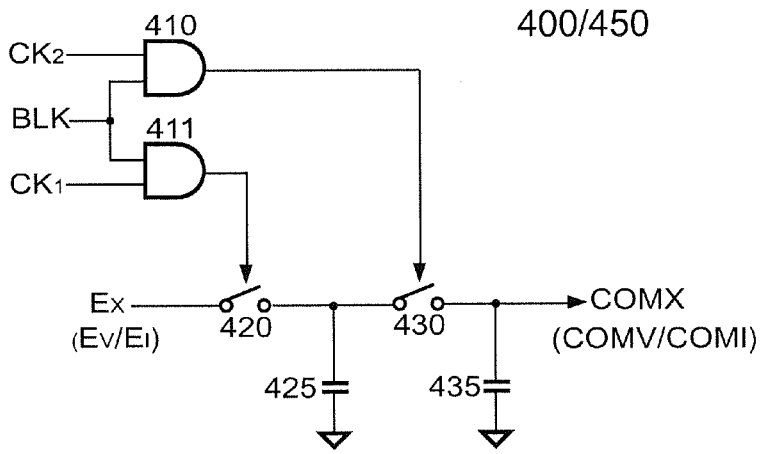
FIG. 7 shows a schematic circuit diagram of an embodiment of the low-pass filter of the switching controller according to the present invention.

FIG. 7 is a preferred circuit schematic of the low-pass filters 400, 450. The low-pass filters 400, 450 are used for low-pass filtering. The low-pass filtering is hold in the previous state when the input-voltage signal $E_{IN}$ is lower than the threshold $V_T$ (as shown in FIG. 5). It includes switches 420, 430 and capacitors 425, 435 to develop a low-pass switching filter for the loop compensation and providing the low pass filtering. One terminal of the switch 420 is couple to receive the amplified signal $E_X$, such as the first amplified signal $E_V$ or the second amplified signal $E_I$. The capacitor 425 is coupled in between another terminal of the switch 420 and the ground. The switch 430 is coupled in between the capacitor 425 and the capacitor 435. The capacitor 435 generates the loop signal COMX, such as the voltage-loop signal COMV or the current-loop signal COMI.

Clocking signals $CK_1$ and $CK_2$ are coupled to an input of AND gates 411 and 410 respectively. The blanking signal BLK is coupled to the other inputs of the AND gates 410 and 411. Output of the AND gate 411 controls the switch 420 for sampling the amplified signal $E_X$ to the capacitor 425. Output of the AND gate 410 controls the switch 430 for sampling the signal stored on the capacitor 425 to the capacitor 435 for generating the loop signal COMX.

The clocking signals $CK_1$ and $CK_2$ are coupled to control the switching of the switches 420 and 430 through the AND gates 411 and 410, in which the blanking signal BLK is coupled to turn off the switches 420 and 430 through the AND gates 410 and 411. Therefore, the signals on the capacitors 425 and 435 will be hold at the previous state once the blanking signal BLK is enabled.

In accordance with the present invention, the feedback loops of the LED driver will be hold at the previous state once the input voltage $V_{IN}$ is lower than the threshold $V_T$. Thus, the feedback loops can be maintained as stable and without the overshoot and undershoot phenomena.

Figure 8:
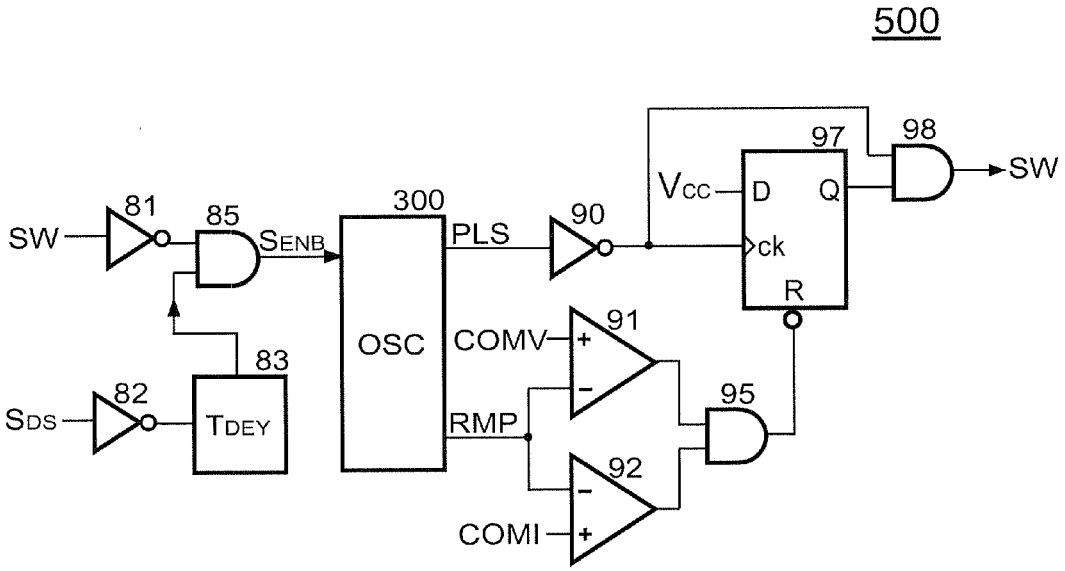
FIG. 8 shows a schematic circuit diagram of an embodiment of the PWM circuit of the switching controller according to the present invention.

FIG. 8 is a preferred circuit schematic of the PWM circuit 500. A signal generation circuit (OSC) 300 generates a pulse signal PLS to turn on the switching signal SW through an inverter 90. The inverter 90 is coupled in between an output of the signal generation circuit 300 and a clock input ck of a flip-flop 97. An input D of the flip-flop 97 is coupled to receive the supply voltage $V_{CC}$. An output Q of the flip-flop 97 is coupled to an input of an AND gate 98 to generate the switching signal SW at an output of the AND gate 98. Another input of the AND gate 98 is coupled to an output of the inverter 90 to receive the pulse signal PLS.

The signal generation circuit 300 further generates a ramp signal RMP coupled to negative-inputs of comparators 91, 92 to compare with the voltage-loop signal COMV and the current-loop signal COMI for turning off the switching signal SW via an AND gate 95. The voltage-loop signal COMV and the current-loop signal COMI are coupled to positive-inputs of the comparators 91, 92 respectively. Inputs of the AND gate 95 are coupled to outputs of the comparators 91, 92. An Output of the AND gate 95 is coupled to a reset-input R of the flip-flop 97 to reset the flip-flop 97 for turning off the switching signal SW.

The signal generation circuit 300 generates the pulse signal PLS in response to an enable signal $S_{ENB}$ to achieve a "boundary current mode (BCM) operation" for the power conversion. The enable signal $S_{ENB}$ is generated in response to the demagnetizing-time signal $S_{DS}$ and the switching signal SW. The BCM operation will help to improve the PF. The demagnetizing-time signal $S_{DS}$ is coupled to generate the enable signal $S_{ENB}$ through an inverter 82, a delay circuit (TDEY) 83 and an AND gate 85. The switching signal $S_W$ is coupled to generate the enable signal $S_{ENB}$ through an inverter 81 and the AND gate 85. The enable of the demagnetizing-time signal $S_{DS}$ means the transformer 10 (as shown in FIG. 3) is fully demagnetized.

An input of the inverter 82 receives the demagnetizing-time signal $S_{DS}$, and an output of the inverter 82 is coupled to an input of the delay circuit 83. An output of the delay circuit 83 is coupled to an input of the AND gate 85. Another input of the AND gate 85 is coupled to an output of the inverter 81. An input of the inverter 81 is coupled to receive the switching signal SW. An output of the AND gate 85 generates the enable signal $S_{ENB}$.

Figure 9:
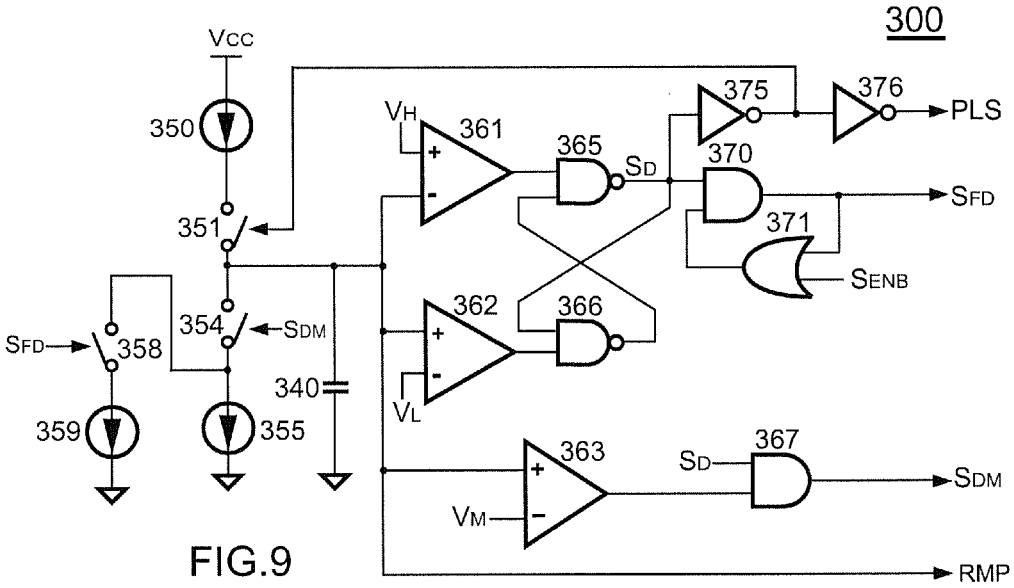
FIG. 9 shows a schematic circuit diagram of an embodiment of the signal generation circuit of the PWM circuit according to the present invention.

FIG. 9 shows a circuit diagram of a preferred embodiment of the signal generation circuit 300. A current source 350 is coupled to charge a capacitor 340 through a switch 351. The current source 350 is coupled in between the supply voltage $V_{CC}$ and one terminal of the switch 351. The capacitor 340 is coupled in between another terminal of the switch 351 and the ground. A current source 355 is coupled to discharge the capacitor 340 via a switch 354. The current source 355 is coupled in between the ground and one terminal of the switch 354. Another terminal of the switch 354 is coupled to the capacitor 340. The switch 351 is controlled by a charge signal. The switch 354 is controlled by a discharge signal $S_{DM}$. The capacitor 340 thus generates the ramp signal RMP coupled to comparators 361, 362 and 363.

The ramp signal RMP is coupled to a negative-input of the comparator 361. The ramp signal RMP is further coupled to positive-inputs of the comparators 362 and 363. The comparator 361 has a threshold $V_H$ coupled to a positive-input of the comparator 361 to compare with the ramp signal RMP. The comparator 362 has a threshold $V_L$ coupled to a negative-input of the comparator 362 to compare with the ramp signal RMP. The comparator 363 has a threshold $V_M$ coupled to a negative-input of the comparator 363 to compare with the ramp signal RMP, and the level of the thresholds is $V_H>V_M>V_L$. NAND gates 365, 366 form a latch circuit coupled to receive the output signals of the comparators 361 and 362. The latch circuit outputs a discharge signal $S_D$. The discharge signal $S_D$ is a maximum frequency signal. An input of the NAND gate 365 is coupled to an output of the comparator 361. An input of the NAND gate 366 is coupled to an output of the comparator 362. Another input of the NAND gate 365 is coupled to an output of the NAND gate 366. An output of the NAND gate 365 generates the discharge signal $S_D$ and is coupled to another input of the NAND gate 366. The discharge signal $S_D$ and an output signal of the comparator 363 are connected to inputs of an AND gate 367 for generating the discharge signal $S_{DM}$.

Figure 10:
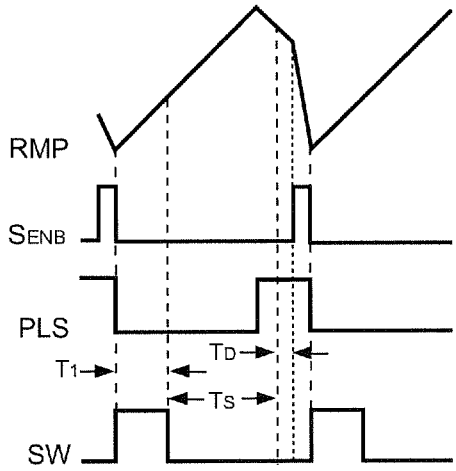
FIG. 10 shows waveforms of the ramp signal RMP, the enable signal $S_{ENB}$, the pulse signal PLS and the switching signal SW of the PWM circuit according to the present invention.

The discharge signal $S_D$ is connected to an inverter 375 to generate the charge signal. The charge signal is connected to an inverter 376 to generate the pulse signal PLS. The pulse signal PLS is generated during the discharge period of the capacitor 340 (as shown in FIG. 10). The discharge signal $S_D$ is further coupled to an input of an AND gate 370 to generate a fast-discharge signal $S_{FD}$. The fast-discharge signal $S_{FD}$ and the enable signal $S_{ENB}$ are connected to inputs of an OR gate 371. An output of the OR gate 371 is connected to another input of the AND gate 370. Therefore, the enable signal $S_{ENB}$ will trigger the fast-discharge signal $S_{FD}$ once the discharge signal $S_D$ is enabled. The fast-discharge signal $S_{FD}$ can be turned off only when the discharge signal $S_D$ is disabled.

A current source 359 is connected between the ground and one terminal of a switch 358. Another terminal of the switch 358 is coupled to the capacitor 340 through the switch 354. The switch 358 is controlled by the fast-discharge signal $S_{FD}$. Since the current of the current source 359 is high, the capacitor 340 will be immediately discharged when the fast-discharge signal $S_{FD}$ is enabled. During the discharge period, the ramp signal RMP is hold at the level of the threshold $V_M$ until the enable signal $S_{ENB}$ starts the fast-discharge signal $S_{FD}$. Once the capacitor 340 is discharged lower than the threshold $V_L$, the discharge signal $S_D$ will be disabled.

The demagnetizing-time signal $S_{DS}$ (as shown in FIG. 8) is thus able to trigger the pulse signal PLS once the discharge signal $S_D$ is enabled. Therefore, the switching control of the power conversion can be operated in BCM. The current of the current source 350, the capacitance of the capacitor 340 and the thresholds $V_H$, $V_M$, $V_L$ determine the maximum frequency of the discharge signal $S_D$, and determine the maximum frequency of the switching signal SW (as shown in FIG. 8).

FIG. 10 shows the switching signal SW is operated at BCM. The switching signal SW is turned on at the period of $T_1$. The period $T_S$ shows the demagnetizing time of the transformer 10 (as shown in FIG. 3). The demagnetizing time is correlated to the demagnetizing-time signal $S_{DS}$.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A control circuit of a LED driver comprising:

an output circuit, the output circuit generating a switching signal to produce an output current for driving at least one LED in response to a feedback signal, in which the switching signal is coupled to switch a transformer;

an input circuit, the input circuit coupled to sample an input signal for generating the feedback signal; and an input-voltage detection circuit, the input-voltage detection circuit coupled to detect an input voltage of the LED driver and generate an input-voltage signal in response to the input voltage of the LED driver;

wherein the input signal is correlated to the output current of the LED driver; the input circuit will not sample the input signal when the input-voltage signal is lower than a threshold.

2. The control circuit as claimed in claim 1, wherein the input circuit further comprises a low-pass filer to provide a constant on time for the switching signal.

3. The control circuit as claimed in claim 2, wherein the low pass filter is hold in the previous state when the input-voltage signal is lower than the threshold.

4. The control circuit as claimed in claim 2, wherein a bandwidth of the low-pass filer is lower than a line frequency.

5. The control circuit as claimed in claim 1, wherein the output circuit generates the switching signal operated in a boundary current mode.

6. The control circuit as claimed in claim 1, wherein the input circuit further comprises an integrator for a constant current control.

7. The control circuit as claimed in claim 1, wherein the input circuit further comprises an error amplifier for developing a feedback loop, the error amplifier is disconnected when the input-voltage signal is lower than the threshold.

8. The control circuit as claimed in claim 1 is a primary-side controlled circuit.

9. The control circuit as claimed in claim 1, further comprising a comparator for comparing the input-voltage signal with the threshold, in which the comparator generates a blanking signal to stop the input circuit sampling the input signal when the input-voltage signal is lower than the threshold.

10. The control circuit as claimed in claim 1, wherein the input circuit comprises:

a current-detection circuit, the current-detection circuit measuring the input signal to generate a current-waveform signal, the input signal being a current-sense signal;

an integrator, the integrator integrates the current-waveform signal for generating the feedback signal, the feedback signal being a current-feedback signal;

an error amplifier, the error amplifier comparing the current-feedback signal with a reference signal to generate an amplified signal; and a low-pass filter, the low-pass filter generating a current-loop signal in response to the amplified signal;

wherein the output circuit generates the switching signal in response to the current-loop signal, the error amplifier is disconnected when the input-voltage signal is lower than the threshold, the low-pass filter is hold in the previous state when the input-voltage signal is lower than the threshold.

11. The control circuit as claimed in claim 1, further comprising a voltage-detection circuit, the voltage-detection circuit generating a demagnetizing-time signal in response to a voltage-sense signal correlated to an output voltage of the LED driver, the output circuit generating the switching signal in response to the demagnetizing-time signal.

12. The control circuit as claimed in claim 1, wherein the input-voltage detection circuit detects the input voltage of the LED driver through a resistor and generates the input-voltage signal in response to the input voltage of the LED driver.

13. A method for controlling a LED driver comprising:

generating a switching signal to produce an output current for the LED driver in response to a feedback signal, in which the switching signal is coupled to switch a transformer;

sampling an input signal for generating the feedback signal, in which the input signal is correlated to the output current of the LED driver;

generating an input-voltage signal in response to the level of an input voltage of the LED driver; and stopping the sample of the input signal when the input-voltage signal being lower than a threshold.

14. The method as claimed in claim 13, wherein the feedback signal is a low bandwidth signal for achieving a constant on-time for the switching signal.

15. The method as claimed in claim 13, wherein the switching signal is operated to achieve a boundary current mode of the power conversion.

16. The method as claimed in claim 13, further error-amplifying the feedback signal, in which the error-amplifying is stopped when the input-voltage signal is lower than the threshold.

17. The method as claimed in claim 13, further comprising a low-pass filtering for the loop compensation, in which the low-pass filtering is hold in the previous state when the input-voltage signal is lower than the threshold.

18. The method for controlling the LED driver as claimed in claim 13 is a primary-side controlled method.

19. The method as claimed in claim 13, wherein the input-voltage signal is generated by detecting the input voltage of the LED driver through a resistor.

20. The method as claimed in claim 13, further generating a demagnetizing-time signal in response to a voltage-sense signal correlated to an output voltage of the LED driver for generating the switching signal in response to the demagnetizing-time signal.

* * * * *